United States Patent [19]

Pettrey, Jr. et al.

[11] 3,964,976

[45] June 22, 1976

[54] PROCESS FOR CLEANING COKE OVEN GAS OFFTAKES

[75] Inventors: James Oliver Pettrey, Jr., Huntington, W. Va.; Rufus Furman Davis, Jr., Russell, Ky.

[73] Assignee: Allied Chemical Corporation, New York, N.Y.

[22] Filed: June 28, 1974

[21] Appl. No.: 484,357

[52] U.S. Cl. ..... 201/2; 202/241; 208/48 R

[51] Int. Cl.[2] ..... C10B 43/02; C10B 43/14; C10B 57/00

[58] Field of Search ..... 201/2; 202/241; 134/20, 134/39; 208/48 R; 15/104.03, 104.05

[56] References Cited

UNITED STATES PATENTS

| | | | |
|---|---|---|---|
| 1,567,416 | 12/1925 | Cagwin | 202/241 |
| 1,698,493 | 1/1929 | Dressler | 201/2 |
| 1,939,112 | 12/1933 | Eulberg | 134/20 X |
| 2,289,351 | 7/1942 | Dixon et al. | 134/20 |
| 2,875,146 | 2/1959 | Hall et al. | 208/48 R |
| 3,416,598 | 12/1968 | Dorn | 201/2 X |
| 3,532,542 | 10/1970 | Shimizu et al. | 134/20 |
| 3,745,110 | 7/1973 | Allred | 201/2 X |
| 3,841,977 | 10/1974 | Stanke et al. | 201/2 X |

OTHER PUBLICATIONS

A. T. Taube; "Decoke Furnace Tubes Faster," 4–74; pp. 151–156; Hydrocarbon Processing.

*Primary Examiner*—Morris O. Wolk
*Assistant Examiner*—Bradley R. Garris
*Attorney, Agent, or Firm*—Gerard P. Rooney; Jack B. Murray

[57] ABSTRACT

Process and apparatus for removing carbon deposits from the inner surfaces of a coke oven gas offtake by introducing steam into the gas offtake in an amount and under conditions sufficient to remove at least a portion of said carbon. The steam may be introduced either countercurrent to, or in the direction of, the flow of the gases exiting through the gas offtake.

8 Claims, 3 Drawing Figures

PROCESS FOR CLEANING COKE OVEN GAS OFFTAKES

BACKGROUND OF THE INVENTION

1. Field of the Invention

This invention relates to coke ovens and more particularly to process and apparatus for removing carbon deposits from coke oven gas offtakes.

2. Description of the Prior Art

In the well known process for producing coke, coal is heated in a coke oven in the substantial absence of air, thereby breaking down the complex coal substance and causing to be evolved combustible gases together with condensible tars and oils leaving as residue, coke. While the precise composition of the gases and tar evolved varies widely depending on the temperature and type of coal employed, such evolved substances are valuable by-products which in the coke ovens (termed "by-product ovens") are removed from the exiting gases. Typically, a by-product oven is provided with one or more large gas offtakes which provide communication between the coke oven chamber and a collector main to provide for the transfer of the gases evolved in the oven to a processing plant for subsequent isolation and recovery of the components thereof. Coke ovens are built adjacent one another and form a coke oven battery which may contain as many as 24 to 48 or more coke ovens in a single battery. Some coke oven batteries are provided with a collector main at each end of the coke ovens which services all of the ovens in the battery.

As the generated gases pass over and through the bed of coal being heated in the oven, some particulate matter is picked up by the gases and carried to the gas offtakes where the particles come into contact with the hot walls and are softened and caused to adhere to these surfaces. In addition, coal tars and other thermal decomposition by-products of the coal are deposited and accumulate in the gas offtake passages, as well as on the inner surfaces of the roof and side walls of the oven. Gradually, the accumulations of carbon deposits build up in the gas offtake passages which can eventually be clogged by these accumulated deposits. If these passages were to close completely, the pressure in the coke oven would build up and the gases evolved therein would escape from the oven by blowing off the charging port covers which are located on the top of the ovens and/or by leaking around the oven doors, thereby presenting the very real danger of ignition of these heated gases, which would be hazardous to the operators of the ovens. Therefore, it is desirable to avoid excessive accumulations of carbon deposits in coke oven gas offtakes.

Conventionally, the ovens are cleaned beween coal charges to the ovens by methods which may involve scraping the interior gas offtake surfaces to dislodge the carbon deposits that have formed. However, such scraping methods inherently involve the use of force to remove these deposits, thus increasing the wear upon the refractory oven surfaces upon which these deposits have formed. Moreover, manual methods of scraping, as by ramming a steel rod into the gas offtake to dislodge the deposits, are somewhat harardous to the personnel involved and are so inefficient. On the other hand, mechanical methods of scraping necessitate added expense due to increased equipment and labor requirements. Furthermore, such scraping operations to remove carbon deposits may be safely performed only when the ovens are substantially empty.

Other methods, such as that disclosed in U.S. Pat. No. 1,862,028, which have been developed for removing carbon deposits involve supplying large quantities of air to the hot, empty oven in an effort to oxidize the carbon deposits, and thereby effectuate their removal. In such methods, a steam jet is typically employed to draw air downwardly through a gas offtake which has been previously opened to the atmosphere and dampered from the collecting main, thereby oxidizing the carbon deposits on the inner surfaces of the gas offtake. The oxidation products and steam then escape through the open charging ports in the coke oven roof. Subsequently, the direction of the steam jet is reversed and air is drawn into the oven through the open charging ports, passing across the inner surfaces of the oven roof to oxidize carbon deposits thereon and exiting the oven to the atmosphere via the gas offtake. However, such air decarbonizing methods are disadvantageous because they may only be performed when the oven is substantially empty to prevent the undesired oxidation of the coal and coke content of the oven bed itself. In addition, such air decarbonization steps may only be performed for a relatively short period of time since the very act of forcing air over the oven surfaces cools these surfaces and eventually lowers their temperature below that which is necessary to sustain the desired oxidation reaction. Thus, in most instances scraping methods are required to supplement the carbon deposit removal effectuated by air decarbonizing.

Accordingly, what is needed is a safer, easier, more efficient and thorough process and apparatus to clean the inner surfaces of coke oven gas offtakes.

SUMMARY OF THE INVENTION

In accordance with the present invention, there are provided process and apparatus for removing carbon deposits from the inner surfaces of coke oven gas offtakes. The coke oven gas offtake assembly of the present invention comprises in combination a gas offtake, steam injection means attached to and communicating with said gas offtake and means for supplying steam under pressure to said injection means. The steam may be introduced into the gas offtake either countercurrent to, or in the direction of, the direction of flow through the gas offtake of the gases which are generated in the coke oven to contact at least a portion of the carbon deposits on the inner surfaces of said gas offtake. The term "gas offtake" as used herein is intended to refer to any of the various known venting apparatus employed in coke ovens for the purpose of removing the gases generating therein and includes the passageways leading from the free space of the coking chamber to the standpipe.

The process of the present invention comprises introducing steam into the coke oven gas offtake in an amount sufficient to remove at least a portion of the carbon deposits on the inner surfaces of said gas offtake.

It has been discovered that by the process and apparatus of the present invention, safer, simpler and more efficient removal of carbon deposits in coke oven gas offtakes may be provided with a minimum of equipment and labor. The cost savings thus realized are especially significant in view of the large tonnages of coke produced annually in industry. In addition, the present invention provides continuous removal of these deposits during operation of the coke oven, thereby overcoming a serious disadvantage of prior art processes, namely, the requirement that the oven be substantially empty when the carbon deposits are removed. More importantly, the process and apparatus of the present invention, in addition to removing carbon deposits that have already been formed, have been found to minimize the formation of carbon deposition, in contrast to prior art processes which were directed only to the removal of such deposits. Furthermore, the present invention decreases the need for supplemental scraping methods and effectuates the removal of both the hard, laminar carbon deposits which forms on those gas offtake passage surfaces which are closest to the oven coking chamber and the softer, "fluf" carbon deposits which form on the cooler surfaces more distant from the oven chamber.

DETAILED DESCRIPTION OF THE INVENTION

As indicated above, the process and apparatus of the present invention permit continuous removal of carbon deposits from the inner surfaces of coke oven gas offtakes and, in addition, aid in preventing further deposits of carbon upon these surfaces.

The term "carbon deposits" are used herein is intended to refer to those deposits which form on the inner surface of a coke oven. Such deposits generally include coal tars and various thermal decomposition by-products together with coal and/or coke particles; for example, those which have been carried to the gas offtake due to the exiting gases. The precise identity of the relative amounts of such carbon deposits will vary greatly depending upon the type of coal being treated in the oven, the oven temperature, the size of the coal charge and other factors.

IT is believed that the steam reacts with carbon deposits in a manner which may be illustrated by the following equations:

$$H_2O(S) + C \rightarrow H_2 + CO \quad -70{,}900 \text{ BTU} \quad (I)$$
$$2H_2O(S) + C \rightarrow 2H_2 + CO_2 \quad -71{,}600 \text{ BTU} \quad (II)$$

The reactions of the steam and the carbon content of the deposits yield gaseous reaction products which pass out the gas offtake assembly together with the gases generated in the oven itself. The above endothermal reactions, together with the lower temperature of the steam in relation to the oven temperature, has a cooling effect on the interior oven surfaces so contacted, thus aiding in minimizing further carbon deposition thereon.

Since coke ovens generally operate at a flue temperature of from 1900° to 2600°F., the gas offtake inner surfaces from which carbon deposits are removed by the present invention are generally at a temperature of from about 1472° to 2300°F., which is sufficient to allow the reactions I and II to proceed. At temperatures below about 1472°F., the removal of the carbon deposits does not proceed at a desirable rate. While steam injection in accordance with the present invention aids in preventing carbon deposits due to the cooling effect discussed above, the cooling thereby effected is generally not sufficient to lower the temperature of the gas offtake inner surfaces below that temperature (i.e. about 1472°F.) at which the reactions I and II proceed at a beneficial rate.

Figure 1:
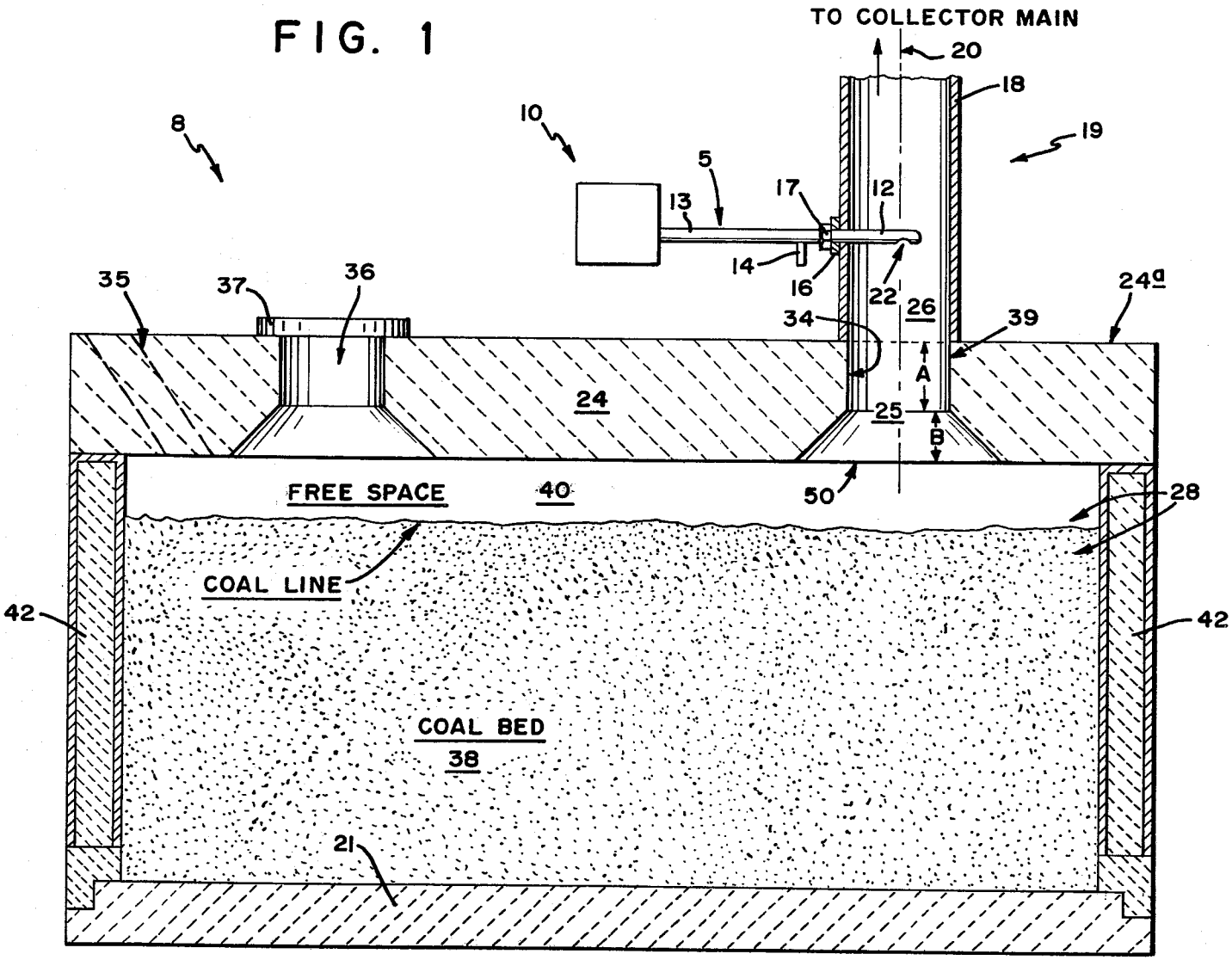
FIG. 1 is a cross-sectional view in elevation of a typical by product coke oven provided with the gas offtake assembly of the present invention.

Reference is made to the drawings wherein like numerals refer to the same or similar element. In FIG. 1 there is illustrated in cross-section one embodiment of the gas offtake assembly of the present invention in combination with a by-product coke oven, indicated generally at 8, which includes base 21, oven doors 42 and roof 24 and which defines coking chamber 28 comprising coal bed 38 and free space 40 above bed 38. Charging port 36 is provided in oven roof 24 and provides communication between chamber 28 and a coal source (not shown) for charging coal into oven 8. Generally, each coke oven is provided with a plurality of charging ports similar to port 36. When not in use during charging, port 36 is provided with cover 37 to prevent the gases generated in oven 8 from escaping through port 36. Alternatively, roof 24 may be provided with pipeline charging passage 35 to provide communication between chamber 28 and a coal source (not shown) for the pipeline charging of coal to oven 8 employing a carrier gas. Typical of pipeline charging systems which may be employed are those disclosed in U.S. Pat. Nos. 3,457,141 and 3,537,755.

Figure 2:
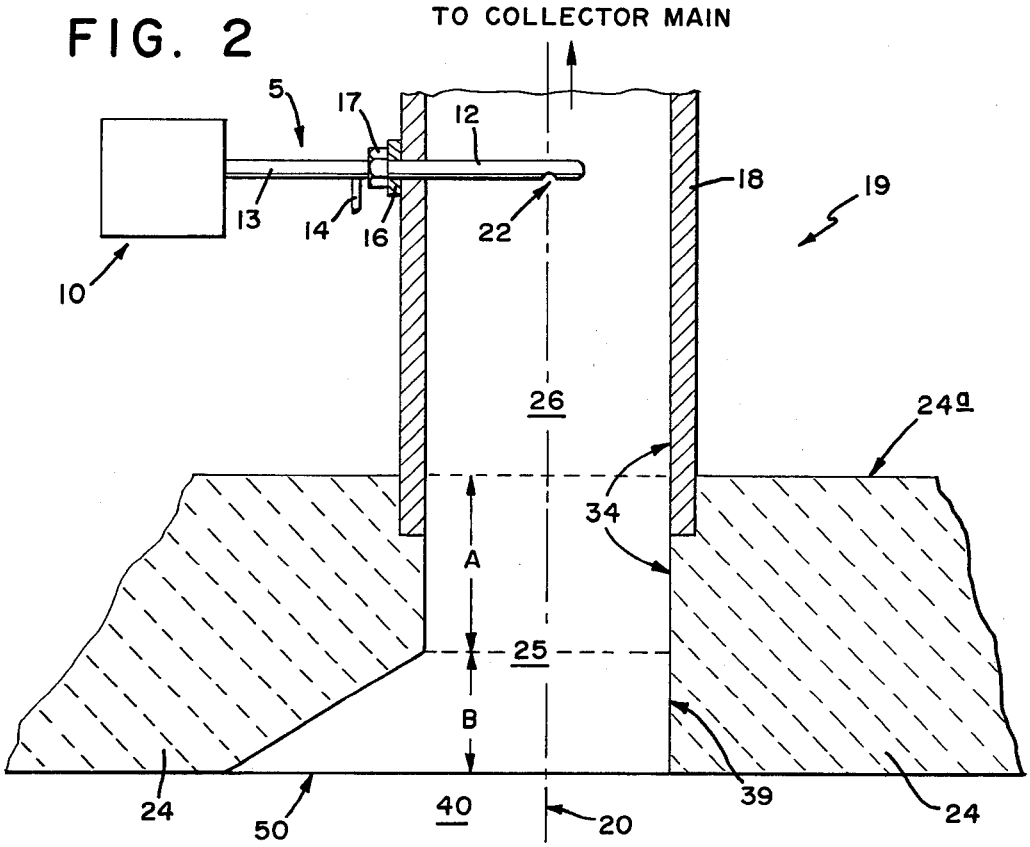
FIG. 2 illustrates gas offtake assembly of the present invention in combination with a second type of coke oven gas offtake.
Figure 3:
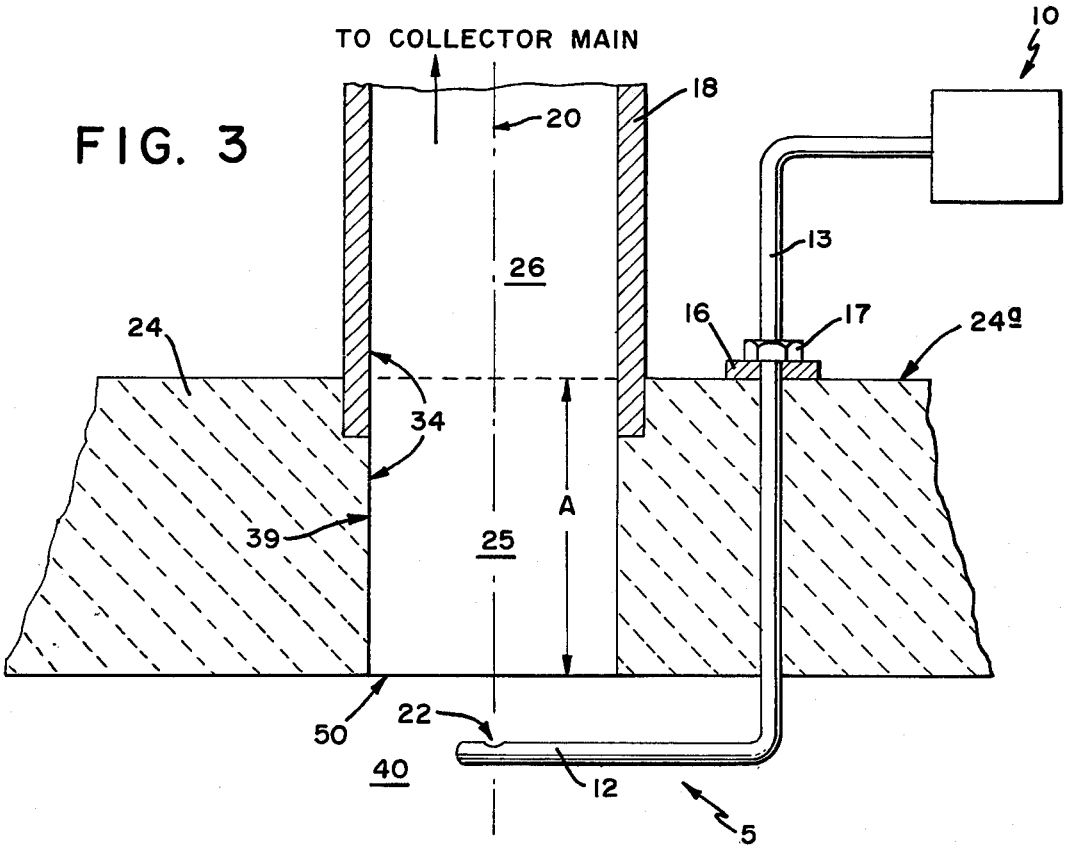
FIG. 3 illustrates another embodiment of the coke oven gas offtake assembly of the present invention.

Oven roof 24 is also provided with a gas offtake indicated generally at 19, for removing gases from chamber 28. Each coke oven may be provided with an additional gas offtake assembly located at the opposite end of the coke oven. Gas offtake 19 comprises vertical standpipe 18 and venting port 39 which communicates successively with free space 40 to provide for the escape from oven 8 of the gases generated therein. In the oven of FIG. 1, venting port 39 defines venting port passage 25 which includes a cylindrical and converging portion designated cylindrical offtake passage A and converging offtake passage B, respectively. However, other gas offtake assembly orientations may be employed. Thus, standpipe 18 may be substantially horizontal and venting port 39 may be either symmetrical or asymetrical. Moreover, as is shown in FIG. 3, a converging passage is not required and venting port 39 may define substantially cylindrical passage 25. Further, while standpipe 18 is shown as mounted on outer roof surface 24a in the oven of FIG. 1, standpipe 18 may be mounted in a recessed position, such as is illustrated in FIGS. 2 and 3. In addition, the number and size of gas offtake 19 is not critical and two or more gas offtakes may be employed. While the present invention is particularly adapted to removing carbon deposits (and preventing further carbon deposition) in gas offtakes of by-product coke ovens wherein it is desired to recover valuable by-products from the gases generated in the oven, the present invention may also be employed to remove carbon deposits (and prevent further such deposits) in the gas offtakes of other coke ovens, such as those wherein no recovery of by-product gases is desired, i.e. ovens in which substantially all of the gases generated are processed to recover heat therefrom to supplement the heat requirements of the oven itself.

For removal of carbon deposits from inner surface 34 of gas offtake 19 oven 8 is provided with a gas offtake assembly comprising gas offtake 19, steam injection means 5 attached to and communicating with said gas offtake and steam supply means 10. Steam injection means 5 includes injection nozzle 12 provided with steam nozzle opening 22 for injecting steam into standpipe passage 26 and steam feeder tube 13 which provides communication between nozzle 12 and steam means 10 for passage of steam to nozzle 12. As shown in FIGS. 1 and 2, steam exits nozzle 12 in a direction which is countercurrent to the direction of flow through gas offtake 19 of the gases generated in oven 8 to provide for removal of carbon deposits from inner surfaces 34 of gas offtake 19 between the point of steam injection in standpipe 18 and the interface, designated 50 in FIG. 1, of venting port passage 25 and free space 40. Steam injection nozzle 12 is provided with washer 16 and locking nut 17 to secure steam nozzle 12 and steam feeder tube 13 to standpipe 18. Nozzle 12 may also be provided with means 14, such as a handle, which may serve as an indicator of the direction in which steam nozzle opening 22 is directed.

While not illustrated, it will be understood that two or more steam injection nozzles 12 may be employed to introduce steam into the passages of gas offtake 19, i.e. into either standpipe passage 26 or venting port passage 25, and that one or more steam nozzle openings 22 may be employed in a given steam injection nozzle 12. The size and number of steam nozzle openings 22 may vary depending upon the mass flow rate of steam desired to be introduced into gas offtake 19, the amount of inner surface 34 to be contacted with steam, the thickness of carbon deposition and other factors. Generally, steam nozzle openings may range from about 1/32 to ⅛ inch in diameter, preferably from about 3/32 to 1/16 inch in diameter.

Steam injection nozzle 12 may be constructed of any material which is capable of withstanding the temperature and pressure conditions of coke oven operation, i.e. a temperature from about 1900° to 2600°F. Preferably, steam injection nozzle 12 is constructed of Iconel steel or a similar high steel alloy having a high nickel content. In FIG. 2 there is illustrated a portion of the roof of a coke oven provided with steam injection means 5 attached to and communicating with gas offtake 19 comprising venting port 39 and standpipe 18. Standpipe 18 is mounted in a recessed position in oven roof 24 providing communication between standpipe passage 26 and venting port passage 25 with free space 40 to provide for the transfer therethrough of gases generated in oven 8 to a collector main (not shown). In the oven of FIG. 2, venting port 39 defines venting port passage 25 which includes a cylindrical portion, designated passage A, and an asymmetric converging portion, designated passage B.

FIG. 3 illustrates another embodiment of the gas offtake assembly of the present invention comprising gas offtake 19, steam injection means 5 communicating with gas offtake 19 and steam supply means 10. Steam injection means 5 comprises steam injection nozzle 12 and steam feeder tube 13 for passing steam from supply means 10 to injection nozzle 12 for injection into gas offtake 19. As shown, steam nozzle 12 is provided with steam nozzle opening 22 and is positioned so as to introduce steam through opening 22 into the gas offtake passages of gas offtake 19 (i.e., into venting port passage 25 and standpipe passage 26) to provide contact of the steam upon inner surface 34 of gas offtake 19 for removal of carbon deposits therefrom. In the embodiment of FIG. 3, steam is injected into gas offtake 19 in the direction of flow of the gases generated in the coke oven. By such cocurrent introduction of steam, carbon deposits may be removed from inner surface 34 upwardly from the interface, designated 50 in FIG. 3, between venting port passage 25 and free space 40.

While the process and apparatus of the present invention may be employed to remove fluf carbon, i.e. the relatively soft carbon deposits that generally occur in gas offtake 19 above outer roof surface 24a, the present invention is particularly adapted to the removal of the hard, laminar carbon deposits which are generally formed on that portion of inner surface 34 which is below the elevation of outer roof surface **24*a*, and more typically on that cylindrical portion of inner surface 34 which lies below the elevation of outer roof surface 24*a***.

Steam nozzle 12 may be positioned for injection of steam at any point in gas offtake 19. Preferably, however, steam nozzle 12 is positioned for injection of steam so as to contact the portion of inner surface 34 upon which the laminar carbon deposition occurs. Thus, nozzle 12 is preferably positioned for countercurrent injection of steam into gas offtake 19 at a point which is above the elevation of outer roof surface **24*a*, and most preferably at a distance of from about 0.5 to 3 feet above surface 24*a*. When steam nozzle 12 is positioned for co-current injection of steam into gas offtake 19, steam nozzle 12 is preferably positioned at a point which is below cylindrical passage A of venting port passage 25. Of the foregoing, countercurrent injection of steam is the most preferred since the positioning of nozzle 12 as shown in FIG. 1** best provides ease of installation and maintenance.

Whether countercurrent or co-current steam injection is employed, steam nozzle 12 is preferably positioned so as to cause the center of steam nozzle opening 22 to be aligned with longitudinal axis 20 of gas offtake 19, thereby causing steam to be introduced along axis 20 to provide for even contact of steam around the inner circumference of gas offtake 19. However, if greater amounts of carbon deposition occur along one side of offtake 19, steam nozzle 12 may be positioned to provide greater steam contact upon that portion of inner surface 34 in lieu of an even contact of steam around the inner circumference of offtake 19.

Steam supply means 10 may comprise any conventional steam supply source and may individually provide steam to a single steam nozzle or a plurality of steam nozzles. Steam supply means 10 may run parallel on top of a coke oven battery and provide the steam to steam injection means 5 located in each gas offtake in each coke oven. The steam can be recycled steam or the steam bled off from the pipeline charging operation mentioned above. Alternatively, steam supply means 10 may comprise a steam line from which steam is transferred via feeder tube 13 to steam injection means 5. Steam may be supplied by supply means 10, for either countercurrent or co-current injection, at a temperature of from about 300° to 1600°F. and preferably from about 350° to 600°F. A steam temperature of greater than 1600°F. may be employed, but the energy required to attain such greater temperatures becomes uneconomical. The pressure at which steam is supplied to steam injection means 5 by steam supply means 10 will vary depending on the mass flow rate of steam desired to be injected, the size of nozzle opening 22 and other factors, but will generally vary from about 75 to 150 psig, preferably from about 80 to 110 psig.

The material of which standpipe 18 and roof 24, which defines venting port 39, are constructed is not critical. Thus, roof 24 may be of high silica brick or other refractory material and standpipe 18 may comprise a steel tubing provided with a refractory lining, as for example with a clay shape lining.

According to the present invention carbon deposits on the inner surfaces of coke oven gas offtakes are removed by a process which comprises introducing steam into said gas offtake so as to contact at least a portion of said carbon deposits with said steam. In one embodiment, the process of the present invention comprises introducing steam in a direction which is countercurrent to the direction of flow of gases generated in the oven during the coking cycle, i.e., the period during which coal is heated in the oven for conversion to coke. The mass flow rate at which steam is injected when countercurrent injection is employed will vary widely depending upon the mass flow rate of the escaping gases generated in the oven during the coking cycle, the size of the coal charge, the positioning of the nozzle through which the steam is injected and other factors but will generally vary from about 0.1 to 2 lbs./min. Thus, for example, a steam flow rate of from about 0.2 to 1.2 lb./min., and preferably 0.5 to 0.8 lb./min., may be employed for a 5 meter coke oven, i.e. an oven 42 feet long, 18 inches wide, and 16 feet high, provided with a 20 inch inside diameter gas offtake and operating at a flue temperature of 2400°F. with a 25 ton charge of bituminous coal. While higher steam mass flow rates may be employed, the steam should not be injected at a rate which causes significant contact of the steam upon the coal bed in the oven, and preferably is injected without substantial penetration by the steam of the free space in the oven, i.e. that space in the oven above the coal bed. Of course, since the rate at which gases are generated in the oven decreases with time of coking and since the extent to which steam injected at a given mass flow rate will penetrate the free space will increase in response to the decrease in gas generation, some contact of the countercurrently injected steam with the coke will inevitably occur during "pushing" of the coke bed for a constant steam injection flow rate. However, such minor steam contact during "pushing" (i.e. the period during which the coke product is pushed out of the oven) is not disadvantageous. Moreover, control of the rate at which steam is injected into the gas offtake during a given coke cycle by known methods will substantially eliminate even the above minor steam contact with the coke content of the bed during pushing.

According to another embodiment of the process of the present invention, steam is introduced into a gas offtake in the direction of flow through said offtake of gases generated in the oven so as to contact the inner surfaces of said gas offtake for removal of carbon deposition therefrom. When such a co-current steam injection method is employed the mass flow rate of steam so injected is not critical and may vary widely depending upon the amount of inner surfaces desired to be contacted, the position in the gas offtake at which steam is injected and other factors. Generally, however, steam flow rates of up to 2 lbs./min., and preferably from about 0.2 to 1.2 lb./min., and most preferably from 0.5 to 0.8 lb./min. may be employed.

Thus, for a 5 meter coke oven having a 25 ton charge of bituminous coal which operates at a flue temperature of 2400°F. and which is provided with a standpipe having an inside diameter of 20 inches, steam injected at a temperature of 400°F. and pressure of 90 psig through an injection nozzle, positioned at a point 2 feet above the outer oven roof surface for countercurrent, coaxial steam injection and provided with a 3/32 inch nozzle opening, effects a steam flow rate of 0.6 lb./min. Continuous operation of the above steam injection process was found to effect removal of carbon deposits on the inner surfaces of the gas offtake so contacted and substantially reduced the need for supplemental scraping of these surfaces to dislodge carbon deposits.

While the process of the present invention is particularly adapted to continuous introduction of steam into gas offtakes for removal of carbon deposits, it will be understood that the present invention may be practiced employing an intermittent injection of steam therein to provide for removal of carbon deposits as desired. If desired, the present invention may be employed in combination with prior art scraping and air decarbonization methods to provide for removal of carbon deposits in coke ovens.

Although certain preferred embodiments of the invention have been disclosed for purpose of illustration, it will be evident to one skilled in the art that various changes and modifications may be made therein without departing from the scope and spirit of the invention.

We claim:

1. In a process for the coking of coal in a coke oven chamber having gas offtakes wherein said coking of coal is effected at flue temperatures from 1900° to 2600°F., the improvement which comprises contacting the inner surfaces of said gas offtakes with steam during the coking operation in an amount sufficient to react with the carbon deposits formed on said inner surfaces during said coking operation, said steam being at a temperature sufficient to maintain the temperature of said inner surfaces above 1472°F., whereby gaseous reaction products of said steam and carbon deposits are obtained while a substantial buildup of carbon deposits on said inner surfaces is prevented.

2. The process according to claim 1 wherein said inner surfaces of said coke oven gas offtakes include a portion below an outer roof surface of a coke oven and wherein said steam is injected into the gas offtakes so as to contact that portion of said inner surfaces of said offtakes below said outer roof surface upon which carbon deposits are formed.

3. The process according to claim 1 wherein said steam is injected into the gas offtakes at a temperature of from about 300° to 1600°F. and a pressure of from about 75 to 150 psig.

4. The process according to claim 1 wherein said gas offtakes have longitudinal axes and wherein the steam is introduced into the gas offtakes along the longitudinal axes thereof.

5. The process according to claim 1 wherein said steam is injected into the gas offtakes in a direction which is countercurrent to the direction of flow therethrough of the gases generated in said coke oven during the coking of coal.

6. The process according to claim 5 wherein said steam is injected at a mass flow rate of from about 0.1 to 2 pounds per minute.

7. The process according to claim 1 wherein said steam is injected into the gas offtakes in the direction of flow therethrough of the gases generated in said coke oven during the coking of coal.

8. The process according to claim 7 wherein said steam is injected at a mass flow rate of up to 2 pounds per minute.

* * * * *